US009525205B2

(12) United States Patent
Oh et al.

(10) Patent No.: US 9,525,205 B2
(45) Date of Patent: Dec. 20, 2016

(54) BEAM FORMING DEVICE AND METHOD FOR FORMING BEAM USING THE SAME

(71) Applicant: Electronics and Telecommunications Research Institute, Daejeon (KR)

(72) Inventors: Jung Hoon Oh, Daejeon (KR); Kwangchun Lee, Daejeon (KR); Nam Hoon Park, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 431 days.

(21) Appl. No.: 14/085,208

(22) Filed: Nov. 20, 2013

(65) Prior Publication Data

US 2014/0292579 A1 Oct. 2, 2014

(30) Foreign Application Priority Data

Apr. 2, 2013 (KR) ..... 10-2013-0035874

(51) Int. Cl.

| | |
|---|---|
| ***H01Q 3/00*** | (2006.01) |
| ***H01Q 3/02*** | (2006.01) |
| ***H01Q 3/34*** | (2006.01) |
| ***H01Q 3/38*** | (2006.01) |

(52) U.S. Cl.

CPC . *H01Q 3/34* (2013.01); *H01Q 3/38* (2013.01)

(58) Field of Classification Search

CPC ..... H01Q 3/26; H01Q 3/2605
USPC ..... 342/81, 154, 372–374; 375/221, 296
See application file for complete search history.

(56) References Cited

U.S. PATENT DOCUMENTS

| | | | | |
|---|---|---|---|---|
| 8,489,041 | B2 | 7/2013 | Teillet et al. | |
| 2007/0131078 | A1* | 6/2007 | Kokkeler | H03F 1/3247 84/1 |
| 2011/0150130 | A1* | 6/2011 | Kenington | H03F 1/3247 375/296 |
| 2011/0255575 | A1* | 10/2011 | Zhu | H04B 1/0475 375/219 |

FOREIGN PATENT DOCUMENTS

| | | |
|---|---|---|
| KR | 10-0562730 | 3/2006 |
| KR | 10-2009-0081086 | 7/2009 |
| KR | 10-2012-0057603 | 6/2012 |

* cited by examiner

*Primary Examiner* — Dao Phan
(74) *Attorney, Agent, or Firm* — Nelson Mullins Riley & Scarborough LLP; Anthony A. Laurentano

(57) ABSTRACT

Provided is a beam forming device. The beam forming device of the present invention may feedback power-amplified signals to perform digital pre-distortion for improving the non-linearity of an analog element in a digital signal process terminal and control a phase for forming a beam. Therefore, the beam forming device that can form an accurate beam may be realized.

14 Claims, 3 Drawing Sheets

BEAM FORMING DEVICE AND METHOD FOR FORMING BEAM USING THE SAME

CROSS-REFERENCE TO RELATED APPLICATIONS

This U.S. non-provisional patent application claims priority under 35 U.S.C. §119 of Korean Patent Application No. 10-2013-0035874, filed on Apr. 2, 2013, the entire contents of which are hereby incorporated by reference.

BACKGROUND OF THE INVENTION

The present invention disclosed herein relates to a wireless communication system, and more particularly, to a beam forming device forming a beam through the control of an antenna array and a method for forming a beam by using the same.

To obtain a geographical coverage serviced by wireless communication systems, the array antenna elements may be controlled in inclination. There are methods for controlling the inclinations of the array antenna elements, which include a method for controlling the positions of the antenna elements to make an inclination mechanically and a method for phase-shifting the signals that are provided or received into the antenna elements to make an inclination electrically.

Since the beam is formed according to the accuracy of the amplitude and the phase of each of RF signals that are supplied into array antennas, the method of making the inclinations of the array antennae mechanically may have a complex structure due to increases of costs, volume, and weight according to needs of the tolerance and accuracy of a phase-shifter.

Also, the method of making an inclination of the array antennae electrically may control each phase of the antenna elements after a power-amplifier. However, due to the non-linearity of the power amplifier, there is a limitation that it is difficult to accurately control the beam of the antenna.

SUMMARY OF THE INVENTION

The present invention provides a beam forming device that is capable of correcting the non-linearity of a power amplifier and a method for forming a beam by using the same.

The present invention also provides a beam forming device that is capable of correcting the non-linearity of a power amplifier to adjust a beam of an antenna accurately and a method for forming a beam by using the same.

Embodiments of the present invention provide devices for forming a beam including: an array antenna forming a beam to transmit a signal; a digital control unit processing a digital signal to generate transmission signals to be provided into each of antenna elements constituting the array antenna; a transceiver unit converting the transmission signals into analog signals; a power amplification unit amplifying the converted analog signals to output the amplified signals to the array antenna; and a signal detection unit detecting signals of each of the antenna elements, wherein the digital control unit generates the transmission signals that are phase-shifted and digital pre-distorted on the basis of the detected signals.

In some embodiments, the transceiver unit may include a plurality of transceivers converting signals that are output to each of the antenna elements into analog signals.

In other embodiments, each of the plurality of transceivers may include: a plurality of digital to analog converters (DAC) converting the transmission signals into the analog signals; and a plurality of mixers up-converting each of the analog signals.

In still other embodiments, the power amplification unit may include a plurality of power amplifiers power-amplifying the signals that are output to the antenna elements.

In even other embodiments, the signal detection unit may include: a switch connected to each of the antenna elements, the switch switching the signals that are transmitted to the antenna elements according to the control of the digital control unit; a mixer down-converting each of the switched signals; and an analog to digital converter (ADC) converting the down-converted signals into feedback digital signals to output the converted signals to the digital control unit.

In yet other embodiments, the digital control unit may include: a distributor distributing the transmission data into each of the antenna elements; digital pre-distorters performing digital pre-distortion on each of the signals that are distributed through the distributor; phase-shifters phase-shifting each of the digital pre-distorted signals; and a control circuit controlling the digital pre-distorters and the phase-shifters on the basis of the digital feedback signals.

In further embodiments, the control circuit may include: a digital pre-distortion (DPD) controller calculating a digital pre-distortion coefficient for the digital pre-distortion based on the detected signal to provide the calculated coefficient into the digital pre-distorters; and an antenna phase controller calculating a phase coefficient for the phase-shifting based on the detected signal to provide the calculated phase coefficient into the phase-shifters.

In still further embodiments, the antenna phase controller may provide the phase coefficient into the phase shifters after the digital pre-distortion is completed in the DPD controllers.

In even further embodiments, the digital control unit may be realized as one of a field programmable gate array (FPGA) and an application specific integrated circuit (ASIC).

In other embodiments of the present invention, methods for forming a beam of a beam forming device including: converting transmission data corresponding to each of antenna elements of the array antenna into analog signals; power-amplifying the analog-converted signals to transmit the amplified signals into each of the antenna elements; switching each of the signals that are transmitted into the antenna elements to convert the switched signals into feedback digital signals; performing digital pre-distortion on the transmission data on the basis of the feedback digital signals; and after the digital pre-distortion of the transmission data is completely performed, shifting phases of the transmission data on the basis of the feedback digital signals.

In some embodiments, the converting of the transmission data into the analog signals may include: distributing the transmission data into each of the antenna elements of the array antenna; converting the distributed transmission data into the analog signals; and up-converting the analog converted signals.

In other embodiments, the converting of the switched signals into the feedback digital signals may include; switching the transmission signals that are transmitted into the antenna elements; frequency down-converting each of the switched signals; and converting the frequency down-converted signals into the digital signals to generate the feedback digital signals.

In still other embodiments, the performing of the digital pre-distortion may include: calculating digital pre-distortion coefficients for improving non-linearity of the analog elements on the basis of the feedback digital signals; and applying the digital pre-distortion coefficients to the transmission data.

In even other embodiments, the shifting of the phases may include: calculating phase coefficients for forming a beam on the basis of the feedback digital signals; and applying the phase coefficients to the transmission data.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Preferred embodiments of the present invention will be described below in more detail with reference to the accompanying drawings. The present invention may, however, merely describe the detailed descriptions related to the operation of the present invention, and other explanation will be ruled out in order not to unnecessarily obscure.

A beam forming device of the present invention includes an array antenna. The array antenna includes a plurality of antenna elements for forming a beam.

Figure 1:
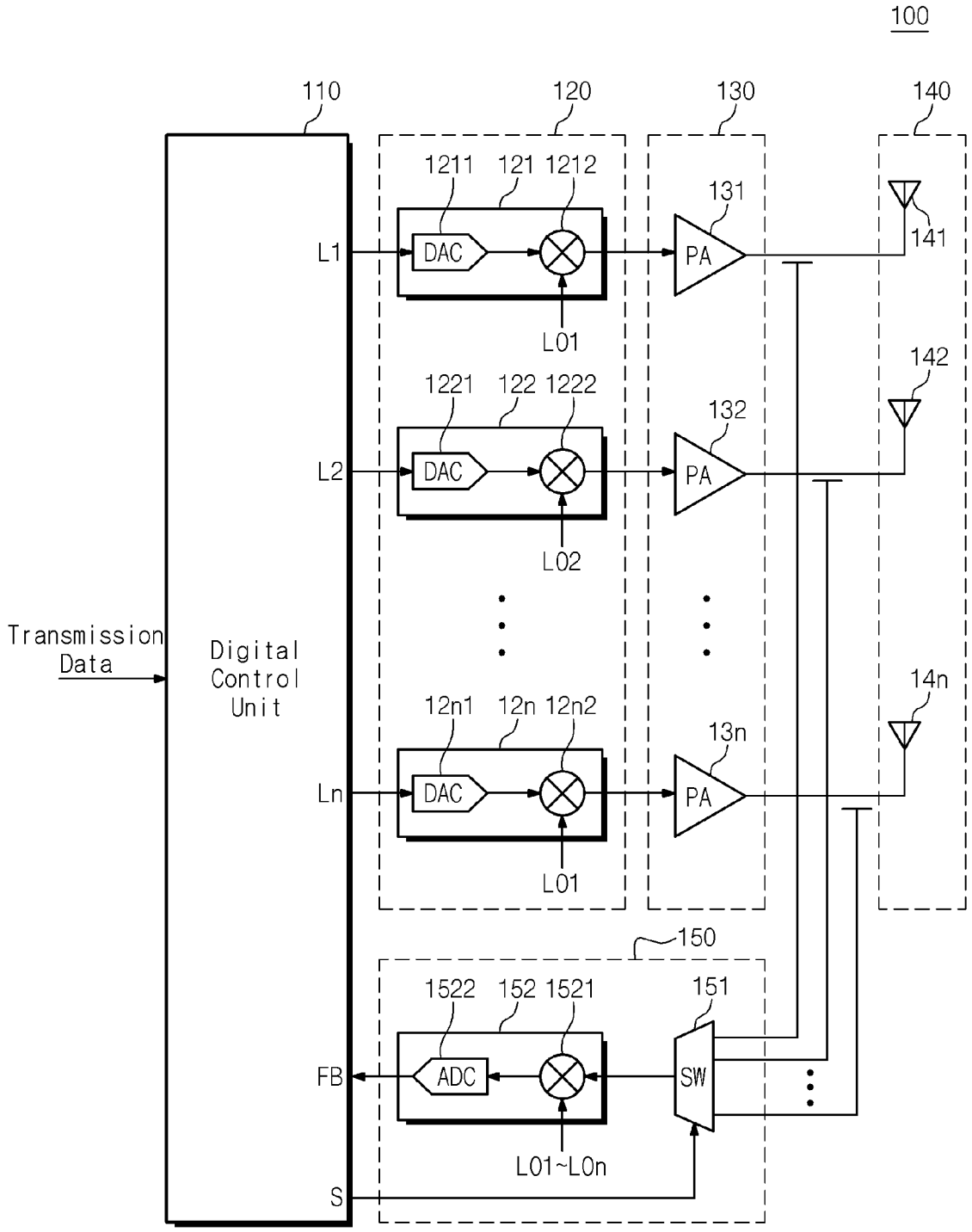
FIG. 1 is a view of a beam forming device according to an embodiment of the present invention.

FIG. 1 is a view of a beam forming device according to an embodiment of the present invention.

Referring to FIG. 1, a beam forming device 100 includes a digital control unit 110, a transceiver unit 120, a power amplification unit 130, an array antenna 140, and a signal detection unit 150.

The digital control unit 110 may receive transmission data. For example, the digital control unit 110 may receive transmission data through a high-speed serial interface. The digital control unit 110 may distribute the transmission data into each of the links L1, L2, . . . , and Ln corresponding to the number of antenna elements 141, 142, . . . , and 14*n*, antenna elements 141, 142, . . . , and 14*n* that constitute the array antenna. That is, the digital control unit 110 may generate transmission signals corresponding to the plurality of links L1, L2, . . . , and Ln from the transmission data. Also, the digital control unit 110 may output the distributed transmission signals to the transceiver unit 120 through each of the links L1, L2, . . . , and Ln.

The transceiver unit 120 may convert the transmission signals into analog signals. The transceiver unit 120 includes transceivers 121, 122, . . . , and 12*n* disposed on a path corresponding to each of the antenna elements 141, 142, . . . , and 14*n*.

The first transceiver 121 includes a first digital to analog converter (DAC) 1211 and a first mixer 1212.

The first DAC 1211 may convert a transmission signal that is received through a first path L1 into an analog signal. The first DAC 1211 may output the analog-converted signal to the first mixer 1212.

The first mixer 1212 may receive the analog-converted signal and mix the analog-converted signal with a first local oscillator signal L01 to up-convert the mixed signal. The first mixer 1212 may output the up-converted signal to the power amplification unit 130.

The second transceiver 122 includes a second digital to analog converter (DAC) 1221 and a second mixer 1222.

The second DAC 1221 may convert a transmission signal that is received through a second path L2 into an analog signal. The second DAC 1221 may output the analog-converted signal to the second mixer 1222.

The second mixer 1222 may receive the analog-converted signal and mix the analog-converted signal with a second local oscillator signal L02 to up-convert the mixed signal. The second mixer 1222 may output the up-converted signal to the power amplification unit 130.

Also, an $n^{th}$ transceiver 12*n* includes an $n^{th}$ digital to analog converter (DAC) 12*n*1 and an $n^{th}$ mixer 12*n*2.

The $n^{th}$ DAC 12*n*1 may convert a transmission signal that is received through an $n^{th}$ path Ln into the analog signal. The $n^{th}$ DAC 12*n*1 may output the analog-converted signal to the $n^{th}$ mixer 12*n*2.

The $n^{th}$ mixer 12*n*2 may receive the analog-converted signal and mix the analog-converted signal with an $n^{th}$ local oscillator signal L0*n* to up-convert the mixed signal. The $n^{th}$ mixer 12*n*2 may output the up-converted signal to the power amplification unit 130.

The power amplification unit 130 may power-amplify the up-converted signals to output the amplified signals to the array antenna 140. The power amplification unit 130 includes a first power-amplifier (PA) 131, a second power-amplifier 132, . . . , and an $n^{th}$ power-amplifier 13*n*.

The first PA 131 may receive a signal that is output through the first mixer 1212 of the first path L1 to output the received signal to the array antenna 140.

The second PA 132 may receive a signal that is output through the second mixer 1222 of the second path L2 to output the received signal to the array antenna 140.

The $n^{th}$ PA 13*n* may receive a signal that is output through the $n^{th}$ mixer 12*n*2 of the $n^{th}$ path Ln to output the received signal to the array antenna 140.

The array antenna 140 includes a plurality of antenna elements 141, 142, . . . , and 14*n* for forming a beam. The array antenna 140 may form a beam to transmit signals that are received through the power amplification unit 130.

The first antenna element 141 may transmit a signal that is output through the first power-amplifier 131.

The second antenna element 142 may transmit a signal that is output through the second power-amplifier 132.

The $n^{th}$ antenna element 14*n* may transmit a signal that is output through the $n^{th}$ power-amplifier 13*n*.

The signal detection unit 150 may switch the power-amplified signals that are output from the power amplification unit 130 to the array antenna 140 according to a switching signal S of the digital control unit 110. The signal detection unit 150 may convert the switched signals into digital signals to output the converted signals to the digital control unit 110. The signal detection unit 150 includes a feedback transceiver 152 and a switch 151.

The switch 151 may be connected to the links between the power-amplifiers 131, 132, . . . , and 13*n* and the antenna elements 141, 142, . . . , and 14*n* of the array antenna 140. The switch 151 may feedback signals that are output to the antenna elements 141, 142, . . . , and 14*n* according to the switching signal S of the digital control unit 110 to output the feedbacked signals to the feedback transceiver 152.

The feedback transceiver 152 includes an $n+1^{th}$ mixer 1521, an analog to digital converter (ADC) 1522.

The n+1$^{th}$ mixer 1521 may multiply the local oscillator signals corresponding to each of the feedbacked signals by each other to down-convert the resultant signals. The n+1$^{th}$ mixer 1521 may output the down-converted signals to the ADC 1522.

The ADC 1522 may convert the down-converted signals into the digital signals. The ADC 1522 may output the digital converted signals to the digital control unit 110.

The digital control unit 110 may receive signals feedbacked with respect to the power-amplified signals for each path. On the basis of these signals, a digital pre-distortion may be performed on the transmission signals that are output from the inside of the digital control unit 110 to each of the elements 141, 142, . . . , and 14*n*. Thus, non-linearity of each of the power-amplifiers 131, 132, . . . , and 13*n* of the power amplification unit 130 may be corrected.

The digital control unit 110 may adjust a beam tilt angle with respect to the digital pre-distorted signals to form a beam. That is, the digital control unit 110 may control the beam forming of the array antenna 140. Thus, the beam forming device 100 of the present invention may feedback the signals that are output from the power-amplifiers 131, 132, . . . , and 13*n* to the digital control unit 110 to correct the non-linearity of the power-amplifiers 131, 132, . . . , and 13*n*. Also, the beam forming device 100 of the present invention may feedback the signals of which the non-linearity is corrected to the digital control unit 110, thereby performing phase-shifting for forming a beam.

Thus, the beam forming device 100 may correct the non-linearity according to the power amplification of the power-amplifiers 131, 132, . . . , and 13*n*. Also the beam forming device 100 may phase-shift the signals of which the not-linearity is corrected to form an accurate beam.

Figure 2:
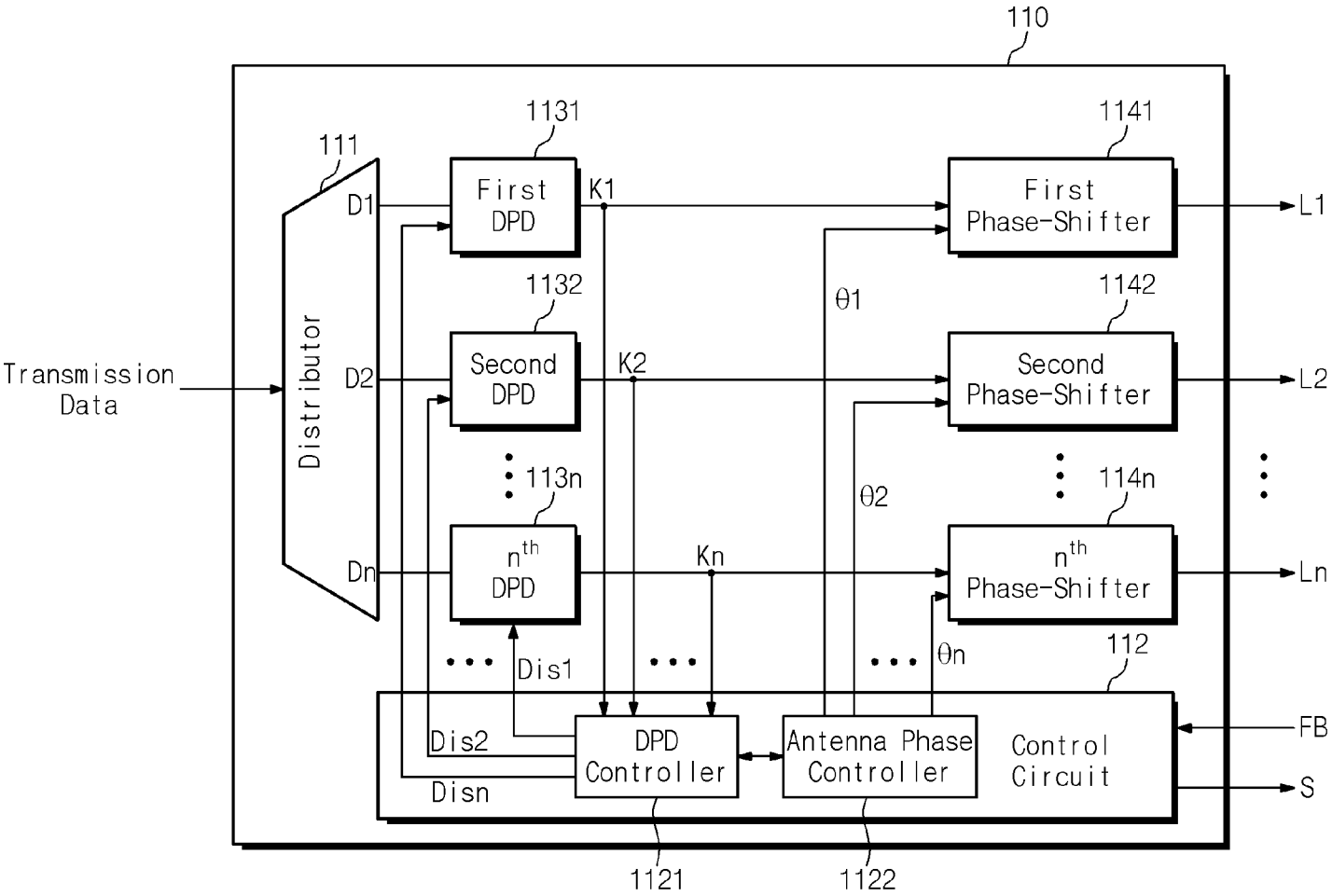
FIG. 2 is a view of a digital control unit of FIG. 1.

FIG. 2 is a view of the digital control unit of FIG. 1.

Referring to FIG. 2, the digital control unit 110 includes a distributor 111, a control circuit 112, a plurality of digital pre-distorters 1131, 1132, . . . , and 113*n* and a plurality of phase-shifters 1141, 1142, . . . , and 114*n*.

The distributor 111 may distribute the transmission data into each of the paths corresponding to the n antenna elements 141, 142, . . . , and 14*n*. The distributor 111 may generate n distributed signals D1, D2, . . . , and Dn.

The control circuit 112 may correct the non-linearity of the power-amplifiers 131, 132, . . . , and 13*n* and control operations of the plurality of digital pre-distorters 1131, 1132, . . . , and 113*n*, the plurality of phase-shifters 1141, 1142, . . . , and 114*n* to control the phase accurately. The control circuit 112 includes a digital pre-distortion (DPD) controller 1121 for controlling the plurality of Digital pre-distorters 1131, 1132, . . . , and 113*n* and an antenna phase controller 1122 for controlling the plurality of phase-shifters 1141, 1142, . . . , and 114*n*.

The DPD controller 1121 may perform a digital pre-distortion algorithm to control the plurality of digital pre-distorters 1131, 1132, . . . , and 113*n*. The digital pre-distortion algorithm is an algorithm for correcting the non-linearity of the power-amplifiers. The DPD controller 1121 may calculate DPD coefficients Dis1, Dis2, . . . , and Disn to perform the digital pre-distortion on the basis of the feedbacked signals with respect to the respective n paths. The DPD controller 1121 may output the calculated DPD coefficients Dis1, Dis2, . . . , and Disn to the digital pre-distorters 1131, 1132, . . . , and 113*n*, respectively.

The antenna phase-controller 1122 may calculate phase-shifted coefficients $\theta_1$, $\theta_2$, . . . , and $\theta_n$ for shifting a phase by using the plurality of phase-shifters 1141, 1142, . . . , and 114*n*, i.e., for phase-shifting. The antenna phase controller 1122 may output the calculated phase-shifted coefficients $\theta_1$, $\theta_2$, . . . , and $\theta_n$ based on the feedbacked signals with respect to the respective n paths to the plurality of phase-shifters 1141, 1142, . . . , and 114*n*. Thus, the antenna phase controller 1222 may control the phases of signals transmitted to the antenna elements 141, 142, . . . , and 14*n*. Through the phase controlling, the antenna phase controller 1122 may control the beam forming operation.

Also, the control circuit 112 may generate a switching signal S controlling a switching operation of the switch 151 for performing feedback on the signals that are output through the power-amplifiers 131, 132, . . . , and 13*n*. The switching signal S may be feedbacked sequentially with respect to each of the paths of the antenna elements 141, 142, . . . , and 14*n*, to perform the digital pre-distortion and the phase-shifting operation for each path. The switching signal S may be generated from the DPD controller 1121 and the antenna phase controller 1122.

The control circuit 112 may receive a feedback with respect to the output of each of the power-amplifiers 131, 132, . . . , and 13*n* through the switching signal S.

The digital pre-distorters 1131, 1132, . . . , and 113*n* may perform the digital pre-distortion to correct the non-linearity of the power-amplifiers 131, 132, . . . , and 13*n*. For this, each of the digital pre-distorters 1131, 1132, . . . , and 113*n* may receive the DPD coefficients Dis1, Dis2, . . . , and Disn from the DPD controller for correcting the non-linearity of the power-amplifiers 131, 132, . . . , and 13*n* that are corresponding to the digital pre-distorters 1131, 1132, . . . , and 113*n*. The correction of the non-linearity indicates that allowing the output with respect to an input of each of the power-amplifiers 131, 132, . . . , and 13*n* to be changed into linearly.

The digital pre-distorters 1131, 1132, . . . , and 113*n* may perform the digital pre-distortion with respect to each of the distributed signals D1, D2, . . . , and Dn according to the control of the control circuit. Each of the digital pre-distorters 1131, 1132, . . . , and 113*n* may function as a pre-filter. Such the digital pre-distorters 1131, 1132, . . . , and 113*n* having a pre-filter function may be realized by a CORDIC (Coordinate Rotation Digital Computer).

The digital pre-distorters 1131, 1132, . . . , and 113*n* may output the digital pre-distorted signals K1, K2, . . . , and Kn to the phase-shifters 1141, 1142, . . . , and 114*n*.

The phase-shifters 1141, 1142, . . . , and 114*n* may phase-shift the digital pre-distorted signals K1, K2, . . . , and Kn. The phase-shifters 1141, 1142, . . . , and 114*m* may shift the phase as the phase-shift coefficients $\theta_1$, $\theta_2$ and $\theta_n$ that are received from the antenna phase controller 1122. The phase-shifters 1141, 1142, . . . , and 114*n* may output the beam forming controlled signals L1, L2, . . . , and Ln by shifting the phase to the transceiver unit 120.

For example, it is assumed that the digital pre-distorted signal K1 inputted into the phase-shifter is expressed as follows: $Am*e^{-iwt}$. Where Am is the size of the transmission signal, w is the phase of the transmission signal. Where $e^{-i\theta t}$ is a coefficient outputted through the antenna phase controller, which phase-shifted as $\theta$.

The phase-shifters 1141, 1142, . . . , and 114*n* disposed on the respective links may multiply each of the digital pre-distorted signals K1, K2, . . . , and Kn by the desired phase $\theta_1$, $\theta_2$, . . . and $\theta_n$. When the input signals K1, K2, . . . , and Kn to the phase-shifters 1141, 1142, . . . , and 114*n* are $Am*e^{-iwt}$, the first phase-shifter 1141 may receive a coefficient $e^{-i\theta 1t}$ to calculate the inputted coefficient with the input signal K1, thereby outputting $Am*e^{-i(w-\theta 1)t}$.

The second phase-shifter 1142 may be input a coefficient $e^{-i\theta 2t}$ to output $Am*e^{-i(w-\theta 2)t}$ by calculating the input signal K2. Also, the $n^{th}$ pre-filter 114*n* may be input a coefficient $e^{-\theta nt}$ to output $Am*e^{-i(w-\theta n)t}$ by calculating the input signal Kn.

The DPD controller 1121 and the antenna phase controller 1122 may control the data that are initially input into the digital pre-distorters 1131, 1132, . . . , and 113*n* and the phase-shifters 1141, 1142, . . . , and 114*n* to bypass the inputted data. Then, the digital pre-distortion operation is completed by the digital pre-distorters 1131, 1132, . . . , and 113*n*, thereafter the phase-shifters 1141, 1142, . . . , and 114*n* may be operated. For this, the antenna phase controller 1122 may turn the operations of the phase-shifters 1141, 1142, . . . , and 114*n* off before the digital pre-distortion is completed by the DPD controller 1121.

The digital control unit 110 of the present invention may correct the non-linearity of the power-amplifiers 131, 132, . . . , and 13*n* and control the phase to form a beam inside of the antenna elements 141, 142, . . . , and 14*n*. The digital control unit 110 may correct the non-linearity generated from analog elements such as the power-amplifiers 131, 132, . . . , and 13*n* and control the phase for each paths forming a beam to form an accurate beam.

The digital control unit 110 may be realized as one of a Field Programmable Gate Array (FPGA) and an Application Specific Integrated Circuit (ASIC).

Therefore, since the beam forming device 100 of the present invention controls the phase on a digital signal terminal, the device may not require a separate phase controller for forming an accurate beam on the analog signal processing terminal for forming a beam.

Figure 3:
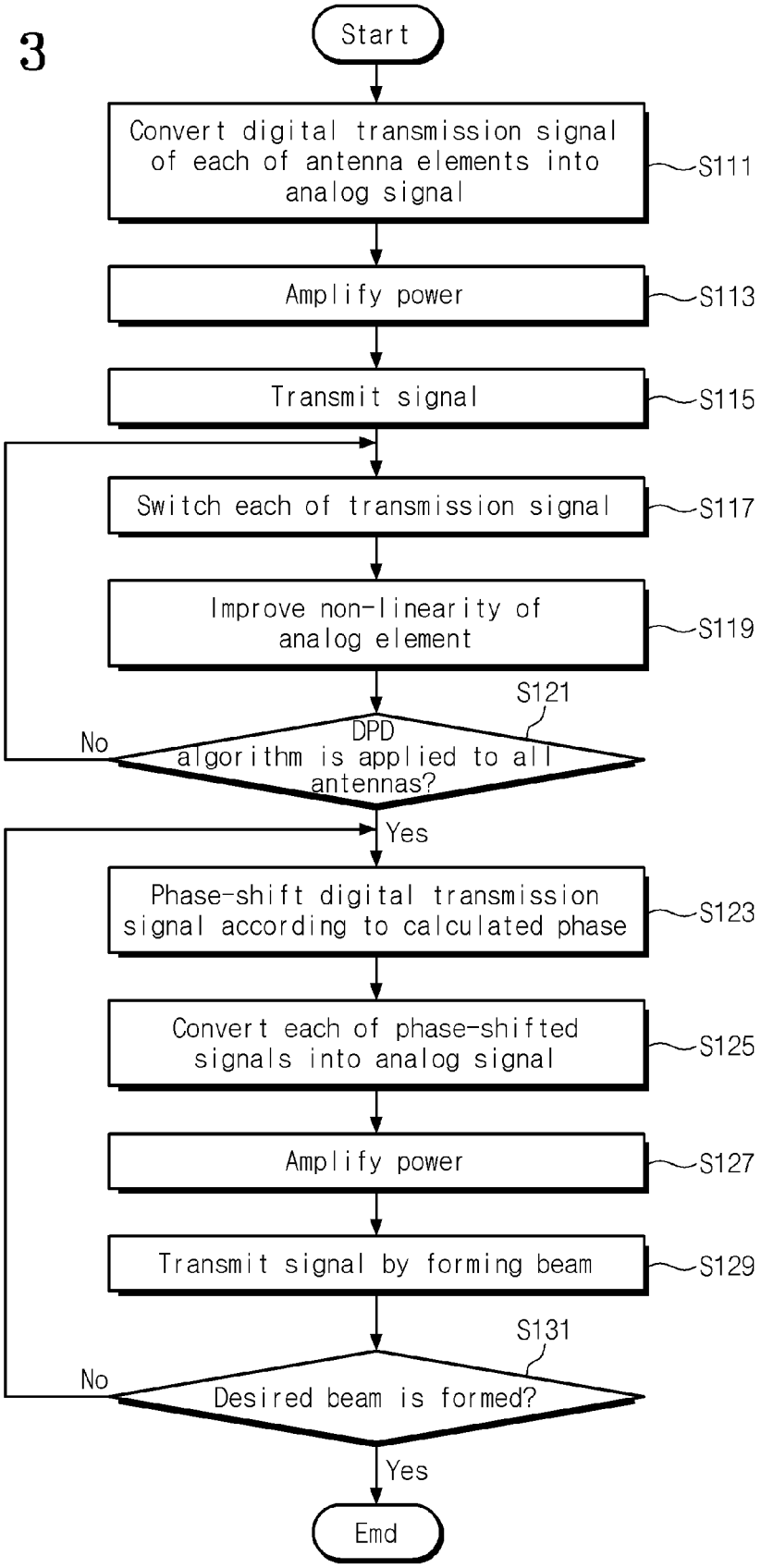
FIG. 3 is a flowchart illustrating a process for forming a beam by using the beam forming device according to an embodiment of the present invention.

FIG. 3 is a flowchart illustrating process for forming a beam by using the beam forming device according to an embodiment of the present invention.

Referring to FIG. 3, in operation S111, the beam forming device 100 may convert each of the digital transmission signals to be transmitted to the antenna elements 141, 142, . . . , and 14*n* into the analog signals. The beam forming device 100 may distribute the received transmission data into each of the links of the antenna elements 141, 142, . . . , and 14*n*. The beam forming device 100 may convert the distributed transmission signals into analog signals.

In operation S113, the beam forming device 100 may power-amplify each of the signals that are converted into the analog signals. The beam forming device 100 may up-convert the converted analog signals into the local oscillator signals for transmitting before the power amplification, to power-amplify the up-converted signals.

In operation S115, the beam forming device 100 may transmit the power-amplified signals through the antenna elements 141, 142, . . . , and 14*n* of the array antenna. The beam forming device 100 may form a beam through the antenna elements 141, 142, . . . , and 14*n* to transmit the signals through the formed beam.

In operation S117, the beam forming device 100 may switch each of the power-amplified signals. The beam forming device 100 may down-convert the switched signals to convert the down-converted signals into the digital signals. In operation S119, the beam forming device 100 may receive the digital converted signals, to perform the digital pre-distortion on the received signals for each of paths of the antenna elements 141, 142, . . . , and 14*n*, thereby improving the non-linearity of each of the analog elements, for example, the non-linearity of each of the power-amplifiers 131, 132, . . . , and 13*n*.

In operation S121, the beam forming device 100 may determine whether application of the digital pre-distortion algorithm is completed with respect to each of the paths of all antenna elements 141, 142, . . . , and 14*n* through the digital pre-distortion. For this, the beam forming device 100 may convert the digital pre-distorted signals into the analog signals to power-amplify each of the analog converted signals The beam forming device 100 may up-convert the converted analog signals into the local oscillator signals for transmitting before the power amplification to power-amplify the up-converted signals. Here, the beam forming device 100 may determine whether application of the digital pre-distortion algorithm is completed through the feedback of the signals outputted to the antenna elements 141, 142, . . . and 14*n*.

As a result of the determination of the operation S121, if the digital pre-distortion algorithm is not applied to all of the antenna elements, the operation S121 may proceed to the operation S115. On the other hand, as a result of the determination of the operation S121, if the digital pre-distortion algorithm is applied to all of the antenna elements, the operation S121 may proceed to operation S123.

In the operation S123, the beam forming device 100 may phase-shift each of the digital transmission signals according to the calculated phase. For this, the beam forming device 100 may calculate the phase for phase-shifting of each of the digital transmission signals with respect to the respective paths.

In operation S125, the beam forming device may convert each of the phase-shifted signals into the analog signals.

In operation S127, the beam forming device 100 may power-amplify each of the signals converted into the analog signals. Here, the beam forming device 100 may up-convert the converted analog signals into the local oscillator signals for transmitting before the power amplification, to power-amplify the up-converted signals.

In operation S129, the beam forming device 100 may form a beam in the array antenna to transmit the signals.

In operation S131, the beam forming device 100 may confirm whether the desired beam is formed through the phase-shifting.

As a result of determination of the operation S131, if the desired beam is not formed, the operation S131 may proceed to the operation S123. On the other hand, if the desired beam is formed, the beam forming control operation for transmitting the signals is stopped.

Therefore, the beam forming device 100 of the present invention may correct the non-linearity of the analog elements within the digital control unit performing the digital signal processing to perform the phase-shifting for forming a beam. Thus, the beam forming device 100 may not require separate elements (such as, digital pre-distorters and phase-shifters) for correcting the non-linearity and the phase-shifting on the analog signal terminal. Also, the beam forming device 100 may feedback the transmission signals outputted through the power-amplifiers 131, 132, . . . , and 13*n* to control the beam forming operation by using the feedbacked signals, thereby forming an accurate beam.

The beam forming device of the present invention may perform the phase-shifting operation for improving the non-linearity of the power amplification unit when the base band signal is processed to improve the non-linearity of the output of the power amplification unit. Also, the beam forming device can use the signals in which the non-linearity of the power amplification unit is corrected to adjust the accurate beam of the antennas.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A beam forming device comprising:

an array antenna forming a beam to transmit a signal;

a digital control unit processing a digital signal to generate transmission signals to be provided into each of a plurality of antenna elements constituting the array antenna;

a transceiver unit converting the transmission signals into analog signals;

a power amplification unit amplifying the converted analog signals to output the amplified signals to the array antenna; and a signal detection unit detecting signals of each of the antenna elements and converting the signals of each of the antenna elements into feedback digital signals, wherein the digital control unit generates the transmission signals that are phase-shifted and digital pre-distorted on the basis of the feedback digital signals, wherein the digital control unit independently controls each of the phases of the transmission signal.

2. The beam forming device of claim 1, wherein the transceiver unit comprises a plurality of transceivers converting signals that are output to each of the antenna elements into analog signals.

3. The beam forming device of claim 2, wherein each of the plurality of transceivers comprises:

a plurality of digital to analog converters (DAC) converting the transmission signals into the analog signals; and a plurality of mixers up-converting each of the analog signals.

4. The beam forming device of claim 1, wherein the power amplification unit comprises a plurality of power amplifiers power-amplifying the signals that are output to the antenna elements.

5. The beam forming device of claim 1, wherein the signal detection unit comprises:

a switch connected to each of the antenna elements, the switch switching the signals that are transmitted to the antenna elements according to the control of the digital control unit;

a mixer down-converting each of the switched signals; and an analog to digital converter (ADC) converting the down-converted signals into the feedback digital signals to output the converted signals to the digital control unit.

6. A beam forming device, comprising:

an array antenna forming a beam to transmit a signal;

a digital control unit processing a digital signal to generate transmission signals to be provided into each of a plurality of antenna elements constituting the array antenna;

a transceiver unit converting the transmission signals into analog signals;

a power amplification unit amplifying the converted analog signals to output the amplified signals to the array antenna; and a signal detection unit detecting signals of each of the antenna elements, wherein the digital control unit generates the transmission signals that are phase-shifted and digital pre-distorted on the basis of the detected signals, wherein the digital control unit comprises:

a distributor distributing the transmission data into each of the antenna elements;

digital pre-distorters performing digital pre-distortion on each of the signals that are distributed through the distributor;

phase-shifters phase-shifting each of the digital pre-distorted signals; and a control circuit controlling the digital pre-distorters and the phase-shifters on the basis of the digital feedback signals.

7. The beam forming device of claim 6, wherein the control circuit comprises:

a digital pre-distortion (DPD) controller calculating a digital pre-distortion coefficient for the digital pre-distortion based on the detected signal to provide the calculated coefficient into the digital pre-distorters; and an antenna phase controller calculating a phase coefficient for the phase-shifting based on the detected signal to provide the calculated phase coefficient into the phase-shifters.

8. The beam forming device of claim 7, wherein the antenna phase controller provides the phase coefficient into the phase shifters after the digital pre-distortion is completed in the DPD controllers.

9. The beam forming device of claim 1, wherein the digital control unit is realized as one of a field programmable gate array (FPGA) and an application specific integrated circuit (ASIC).

10. A method for forming a beam of a beam forming device, the method comprising:

generating transmission signals to distribute transmission data into digital signals corresponding to each of a plurality of antennas, converting the transmission signals into analog signals;

power-amplifying the analog-converted signals to transmit the amplified signals into each of the antenna elements; and switching each of the signals that are transmitted into the antenna elements to convert the switched signals into feedback digital signals;

wherein the generating of the transmission signals comprises:

performing digital pre-distortion on the digital signals on the basis of the feedback digital signals; and after the digital pre-distortion of the transmission data is completely performed, shifting independently the phases of the digital signals on the basis of the feedback digital signals.

11. The method of claim 10, wherein the converting of the transmission signals into the analog signals comprises up-converting the analog converted signals.

12. The method of claim 10, wherein the converting of the switched signals into the feedback digital signals comprises;

switching the signals that are transmitted into the antenna elements;

frequency down-converting each of the switched signals; and converting the frequency down-converted signals into the digital signals to generate the feedback digital signals.

13. The method of claim 10, wherein the performing of the digital pre-distortion comprises:

calculating digital pre-distortion coefficients for improving non-linearity of the analog elements on the basis of the feedback digital signals; and applying the digital pre-distortion coefficients to the digital signals.

14. The method of claim 10, wherein the shifting of each of the phases comprises:

calculating phase coefficients for forming a beam on the basis of the feedback digital signals; and applying the phase coefficients to the digital signals.

* * * * *